US010309386B2

(12) United States Patent
Liang et al.

(10) Patent No.: US 10,309,386 B2
(45) Date of Patent: Jun. 4, 2019

(54) SOLID STATE PUMP USING ELECTRO-RHEOLOGICAL FLUID

(71) Applicants: Massachusetts Institute of Technology, Cambridge, MA (US); Utah State University, Logan, UT (US)

(72) Inventors: Youzhi Liang, Cambridge, MA (US); Anette E. Hosoi, Cambridge, MA (US); Matthew F. Demers, Cambridge, MA (US); Karl D. Iagnemma, Belmont, MA (US); Jose R. Alvarado, Cambridge, MA (US); Regan A. Zane, Hyde Park, UT (US); Michael Evzelman, Logan, UT (US)

(73) Assignees: Massachusetts Institute of Technology, Cambridge, MA (US); Utah State University, Logan, UT (US)

( * ) Notice: Subject to any disclaimer, the term of this patent is extended or adjusted under 35 U.S.C. 154(b) by 163 days.

(21) Appl. No.: 15/296,694

(22) Filed: Oct. 18, 2016

(65) Prior Publication Data

US 2017/0298917 A1 Oct. 19, 2017

Related U.S. Application Data

(60) Provisional application No. 62/243,377, filed on Oct. 19, 2015.

(51) Int. Cl.

| | |
|---|---|
| ***F04B 43/04*** | (2006.01) |
| ***F04B 19/00*** | (2006.01) |
| ***F04B 17/00*** | (2006.01) |

(52) U.S. Cl.

CPC ..... *F04B 43/043* (2013.01); *F04B 17/00* (2013.01); *F04B 19/006* (2013.01)

(58) Field of Classification Search

CPC ..... F04B 43/043; F04B 17/00; F04B 17/03

(Continued)

(56) References Cited

U.S. PATENT DOCUMENTS 4,344,743 A 8/1982 Bessman et al.
5,164,598 A 11/1992 Hillman et al.

(Continued)

FOREIGN PATENT DOCUMENTS

WO WO 2015/149682 A1 10/2015

OTHER PUBLICATIONS

PCT Search Report & Written Opinion of the ISA dated Jun. 9, 2017 from International App. No. PCT/US16/55241; 13 Pages.

(Continued)

*Primary Examiner* — Charles G Freay

(74) *Attorney, Agent, or Firm* — Daly, Crowley, Mofford & Durkee, LLP

(57) ABSTRACT

The systems and methods described herein are directed towards a solid state pumping system that utilizes an electric field applied across a channel formed within the solid state pump to move electro-rheological (ER) fluid from an inlet fluidly coupled to a first end of the channel to an outlet fluidly coupled to a second end of the channel. The solid state pumping system may include first, second and third plate with the second plate disposed between the first and third plate. The second plate may include a channel having first and second circuits coupled to opposing sides of the channel. In an embodiment, in response to a voltage applied thereto, the first and second circuits can provide an electric field voltage across the channel such that in response to the electric field voltage the ER fluid moves from the first end to the second end of the channel.

15 Claims, 11 Drawing Sheets

(58) Field of Classification Search
USPC ..... 417/48, 50
See application file for complete search history.

(56) References Cited

U.S. PATENT DOCUMENTS

| | | | | |
|---|---|---|---|---|
| 5,277,556 | A | 1/1994 | van Lintel | |
| 5,304,487 | A | 4/1994 | Wilding et al. | |
| 5,375,979 | A | 12/1994 | Trah | |
| 5,632,876 | A | 5/1997 | Zanzucchi et al. | |
| 5,685,698 | A * | 11/1997 | Smoll | B63H 11/025 417/50 |
| 5,763,951 | A | 6/1998 | Hamilton et al. | |
| 5,777,644 | A * | 7/1998 | Yamaguchi | B41J 2/04 347/44 |
| 6,019,882 | A | 2/2000 | Paul et al. | |
| 6,277,257 | B1 | 8/2001 | Paul et al. | |
| 6,491,684 | B1 | 12/2002 | Joshi et al. | |
| 6,733,244 | B1 * | 5/2004 | Fritsch | B01F 13/0077 417/48 |
| 6,805,783 | B2 | 10/2004 | Ohkawa | |
| 6,827,906 | B1 * | 12/2004 | Bjornson | G01N 27/44791 204/601 |
| 7,758,316 | B2 * | 7/2010 | Bonne | H01J 49/12 250/283 |
| 2005/0141999 | A1 * | 6/2005 | Bonne | B82Y 10/00 417/48 |
| 2012/0273053 | A1 * | 11/2012 | Murphy | F15B 21/065 137/13 |
| 2015/0020109 | A1 * | 1/2015 | Higa | H04N 21/4312 725/47 |
| 2015/0069680 | A1 * | 3/2015 | Kuri | H02K 44/06 266/241 |

OTHER PUBLICATIONS

Liang; "Design and Optimization of Micropumps Using Electrorheological and Magnetorheological fluids"; Massachusetts Institute of Technology; Jul. 30, 2015; 76 Pages.

Soukup; "Measurement of Flow in a Microfluidic Channel in Response to Application of Voltage"; Massachusetts Institute of Technology; Jul. 30, 2014; 20 pages.

The Physics Classroom; "Electric Field Intensity"; Static Electricity—Lesson 4—Electric Fields; Sep. 29, 2015; 6 Pages.

International Preliminary Report on Patentability for PCT Appl. No. PCT/US2016/055241 dated May 3, 2018; 7 pages.

Olsson, et al.; "A Valve-Less Planar Fluid Pump with Two Pump Chambers;" Elsevier Science; Sensors and Actuators A; Jan. 1995; pp. 549-556; 7 pages.

* cited by examiner

SOLID STATE PUMP USING ELECTRO-RHEOLOGICAL FLUID

CROSS-REFERENCE TO RELATED APPLICATION

The application claims the benefit of U.S. Provisional Application 62/243,377, titled "Solid State Pump Using Electro-Rheological Fluid," filed on Oct. 19, 2015. The entire disclosure of which is hereby incorporated herein by reference in its entirety.

GOVERNMENT INTERESTS

This invention was made with the government support under Contract No. W31P4Q-13-1-0013 awarded by the U.S. Army. The government has certain rights in this invention.

BACKGROUND

As is known in the art, micropumps have rapidly expanded micro-hydraulic systems into a wider range of applications, such as drug delivery, chemical analysis and biological sensing. Empirical research has shown that micropumps suffer most from their extremely low efficiency.

In terms of actuation principles, the mechanical methods include piezoelectric, bimetallic, thermo-pneumatic, electrostatic, electromagnetic actuation and shape memory alloy (SMA). The non-mechanical methods include magneto-hydrodynamic (MHD), electro-hydrodynamic (EHD), and electro-osmotic actuation.

Piezoelectric actuation has been commonly used in reciprocating micropumps. This actuation concept is based upon the piezoelectric effect which correlates mechanical deformation and electrical polarization. Due to the fast response and precise dosage, piezoelectric micropumps are often used to maintain therapeutic efficacy, such as drug delivery. However, the drawbacks for the piezoelectric micropumps are considered to be the high actuation voltage and the mounting procedure.

Thermo-pneumatic micropumps are designed by a periodic change in the volume of the chamber expanded and compressed by a pair of heater and cooler. Micromachining, either for the heater and cooler or the diaphragm; contributes to the realization of this principle. The crucial disadvantages for thermo-pneumatic micropumps is the long thermal relaxation time constant of the cooling process which will limit the bandwidth of the actuation, and the driving power which is required to be maintained at a specified-constant level.

Shape memory alloy (SMA) micropumps generally refer to those applying the shape memory effect (SME) of an SMA (e.g., Titanium/Nickel (TiNi)), resulting in large pumping rates and high operating pressures. The main disadvantages of this approach are the relatively high power consumption indicating a low efficiency and the uncontrollable deformation of SMA due to its temperature sensitivity.

In an embodiment, considering the efficiency of micro-hydraulic systems, all types of pumps described above suffer from a low efficiency. Typically, the overall efficiency of a micro-pump is determined by the product of four components: volumetric efficiency, hydraulic efficiency, mechanical efficiency and electrical efficiency. Volumetric losses and hydraulic losses dominate at small scales, although an acceptable efficiency for macro-pumps has already been achieved. As the size of the system decreases, the volumetric efficiency is dramatically affected since the same dimensional and geometric tolerance result in a larger dimension fraction. In terms of hydraulic efficiency, a Reynolds number also decreases as the characteristic length scales decreases, leading to larger viscous losses. Especially at low pressure, the efficiency of all types of micro-pumps is quite low.

SUMMARY

The systems and methods described herein provide a method for pumping fluid in a hydraulic system, such as a solid state pump, which utilizes electro-rheological (ER) fluid as the hydraulic fluid. In an embodiment, a pumping system may include one or more plates. For example, in some embodiments, a middle plate can be disposed between an upper plate and a lower plate. The plates may be provided from a dielectric material or other non-conducting material. For example, in one embodiment, the plates may be provided as transparent acrylic plates.

In some embodiments, the above pumping system can include one or more of the following aspects in any combination. The middle plate may include a channel through which the ER fluid may flow. In an embodiment, along the channel in the middle plate, two circuits, acting as electrodes, may be wrapped through the channel and around one or more surfaces of the middle plate. In response to an applied voltage, the circuits generate an electric field across the channel.

In response to the applied voltage (and resultant electronic field), ER fluid within the channel can be turned into chains of solid particles. By varying the applied voltage, the formed chains of particles may move along the channel, for example, from an inlet to an outlet. As a result, the ER fluid can be moved by the force of the electric field, dipole-dipole interaction, and drag, such that ER fluid is pumped from the inlet to outlet.

In some embodiments, the above pumping system can include one or more of the following aspects in any combination. An edge of the middle plate may be used to couple the circuits, and thus the pumping system, to an independent power source. The lower plate may serve as a base of the pumping system.

In some embodiments, the above pumping system can include one or more of the following aspects in any combination. The circuits may include electrodes which may be spaced long an edge of the middle plate based on a desired magnitude of a voltage to be applied to the channel. In some embodiments, the electrodes may be equally distributed along an edge of the middle plate. However, it should be appreciated, that a width and spacing of the electrodes can be varied according to the requirements of specific maximum pressure differential and a desired flow rate of the fluid through the channel.

For example, the electrodes may have a generally radial pattern to balance the limitation of the spacing along the channel and a requirement of the edge of the middle plate for connecting to a power supply to ensure insulation. It should be appreciated that the quantity of the electrodes can vary and be modified accordingly as the required nominal pressure differential varies.

In some embodiments, the above pumping system can include one or more of the following aspects in any combination. The plates may be secured together by various coupling means. For example, in some embodiments, screws and locknuts may be distributed along the channel to couple the plates together. In an embodiment, an adhesive layer may be disposed between the plates to secure the plates together and to also provide a seal to prevent fluid from moving to undesired areas (e.g. to prevent leaks between the plates).

In some embodiments, the above pumping system can include one or more of the following aspects in any combination. The system may include two pairs of pitot tubes and graduated scales to measure a pressure differential of the solid state pump. The pressure differential can be indicated by a difference between the heights of the fluid surfaces in the pitot tubes. In some embodiments, two components with a stair step cross-section can be included to mount the pitot tubes and graduated scales on the upper plate.

In an embodiment, ER fluids may include suspended non-conducting particles, up to 100 micrometers, in an insulating fluid. The operational mode for ER fluid can be categorized as flow mode, shear mode and squeeze mode. Typical applications for ER fluids can be used in applications such as valves, clutches, absorbers, and engine mounts. There are a wide range of application benefits from the characteristics of ER fluids, including fast dynamic response, facile mechanical interface connection and accurate controllability.

In one aspect, a solid state pumping system is provided having a first plate having first and second opposing surfaces and a second plate having first and second opposing surfaces. The second plate can be disposed under the second surface of the first plate. The second plate may include a channel formed within the second plate, having a first end and a second end. The second plate may further include a first circuit coupled to a first side of the channel and a second circuit coupled to a second side of the channel. In an embodiment, in response to a voltage applied thereto, the first and second circuits can provide an electric field voltage across the channel such that in response to the electric field voltage an electro-rheological (ER) fluid moves from the first end to the second end of the channel. The solid state pump system may further include a third plate having first and second opposing surfaces. The third plate can be disposed under the second surface of the second plate.

In some embodiments, the above pumping system can include one or more of the following aspects in any combination. A plurality of electrodes can be coupled to each of the first and second circuits. A spacing of the plurality of electrodes along a length of the first and second circuits respectively can determine a magnitude of the electric field voltage applied across the channel. In some embodiments, a flow rate of the electro-rheological fluid through the channel is based, at least in part, on dimensions of the channel and the magnitude of the electric field voltage.

In some embodiments, the above pumping system can include one or more of the following aspects in any combination. In an embodiment, a first fluid path (e.g. a tube) can be coupled to an inlet formed through a first portion of at least one of the first plate or the third plate and coupled to the first end of the channel. The first tube may provide the ER fluid to the first end of the channel. A second fluid path (e.g. a tube) may be coupled to an outlet formed through a second portion of at least one of the first plate or the third plate and coupled to the second end of the channel. The second tube can receive the ER fluid.

In some embodiments, the above pumping system can include one or more of the following aspects in any combination. The second plate may comprise a recessed region on each of the first and second surfaces. The recessed region having a shape and dimension selected to accommodate the first and second circuits such that the surfaces of first and second circuits are substantially flush with the non-recessed portions of the first and second surfaces of the second plate.

In some embodiments, the above pumping system can include one or more of the following aspects in any combination. The solid state pump may include a means for coupling the first and second circuits to the recessed region on the first surface of the second plate and the first and second circuits to the recessed region on the second surface of the second plate. A depth of the recessed regions on the first surface of the second plate may correspond to a thickness of the means for coupling and a depth of the recessed regions on the second surface of the second plate may correspond to a thickness of the means for coupling.

In some embodiments, the above pumping system can include one or more of the following aspects in any combination. The second surface of the first plate can have a first recessed region. The first recessed region can have a shape and dimension selected to accommodate the first and second circuits such that the surfaces of first and second circuits are substantially flush with the non-recessed portions of the second surface of the first plate. The first surface of the third plate can have a second recessed region. The second recessed region having a shape and dimension selected to accommodate the first and second circuits such that the surfaces of first and second circuits are substantially flush with the non-recessed portions of the first surface of the third plate. A depth of the first recessed region on the second surface of the first plate can correspond to a thickness of the means for coupling and a depth of the second recessed region on the first surface of the third plate can correspond to a thickness of the means for coupling.

In some embodiments, the above pumping system can include one or more of the following aspects in any combination. The first circuit can be wrapped through the channel and coupled to the first and second surfaces of the second plate and the second circuit can be wrapped through the channel and coupled to the first and second surfaces of the second plate.

In an embodiment, the first circuit may include a plurality of cathodes and the second circuit may include a plurality of anodes to form dipole-dipole interaction across the channel to move the electro-rheological fluid from the first end to the second end of the channel.

In some embodiments, the above pumping system can include one or more of the following aspects in any combination. Each of the first, second and third plates may include transparent acrylic plates. In an embodiment, the channel may be a first one of a plurality of channels formed within the second plate, wherein the electric field voltage is applied across each of the plurality of channels.

In another aspect, a method for solid state pumping is provided. The method includes introducing an ER fluid into a channel formed within a second plate. The second plate may be disposed under a second surface of a first plate. A first end of the channel can be coupled to an inlet and a second end of the channel can be coupled to an outlet. The method may further include applying an electric field voltage across the channel using a first circuit coupled to a first side of the channel and a second circuit coupled to second side of the channel. The electric field voltage can change a property of the electro-rheological fluid to move the electro-rheological fluid from the first end of the channel to the second end of the channel.

In some embodiments, the above method for solid state pumping can include one or more of the following aspects in any combination. The method can include receiving the ER fluid at the outlet formed through a portion of at least one of the first plate or a third plate. The third plate may be disposed under a second surface of second plate. A flow rate of the ER fluid through the channel can be based, at least in part, on dimensions of the channel and a magnitude of the applied electric field voltage.

In some embodiments, the above method for solid state pumping can include one or more of the following aspects in any combination. The electric field voltage can be varied at one or more points along the channel to move the electro-rheological fluid from the first end to the second end. The electro-rheological fluid can be pumped from the inlet to the outlet based on the applied electric field, dipole-dipole interaction and a drag factor.

In some embodiments, the above method for solid state pumping can include one or more of the following aspects in any combination. The first circuit can be wrapped through the channel and coupled to the first and second surfaces of the second plate and the second circuit can be wrapped through the channel and coupled to the first and second surfaces of the second plate to generate a horizontal electric field voltage across the channel.

BRIEF DESCRIPTION OF THE DRAWINGS

The foregoing concepts and features may be more fully understood from the following description of the drawings. The drawings aid in explaining and understanding the disclosed technology. Since it is often impractical or impossible to illustrate and describe every possible embodiment, the provided figures depict one or more illustrative embodiments. Accordingly, the figures are not intended to limit the scope of the concepts, systems and techniques described herein. Like numbers in the figures denote like elements.

DETAILED DESCRIPTION

Figure 1:
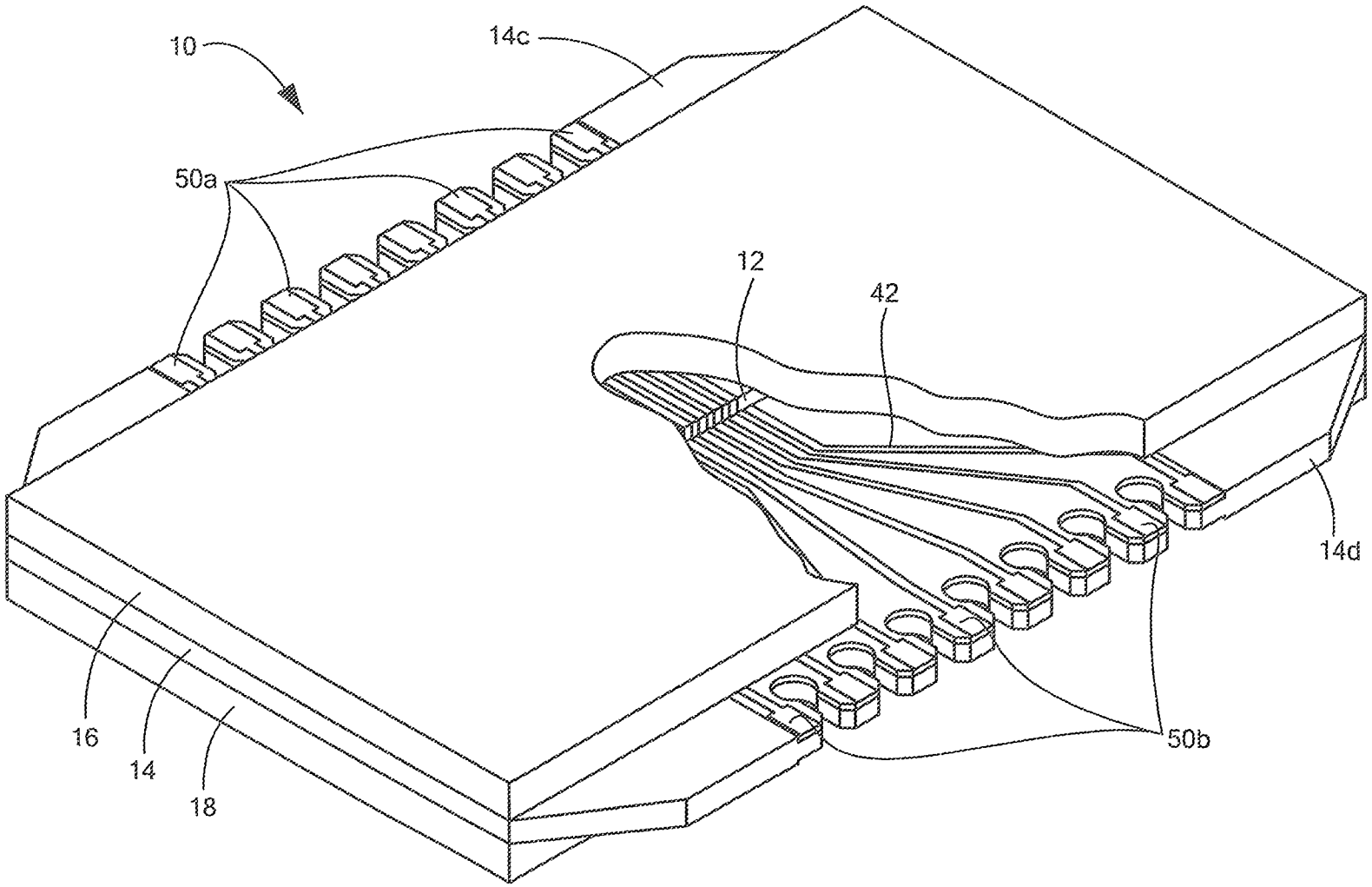
FIG. 1 is an isometric view of a solid state pump system.
Figure 2:
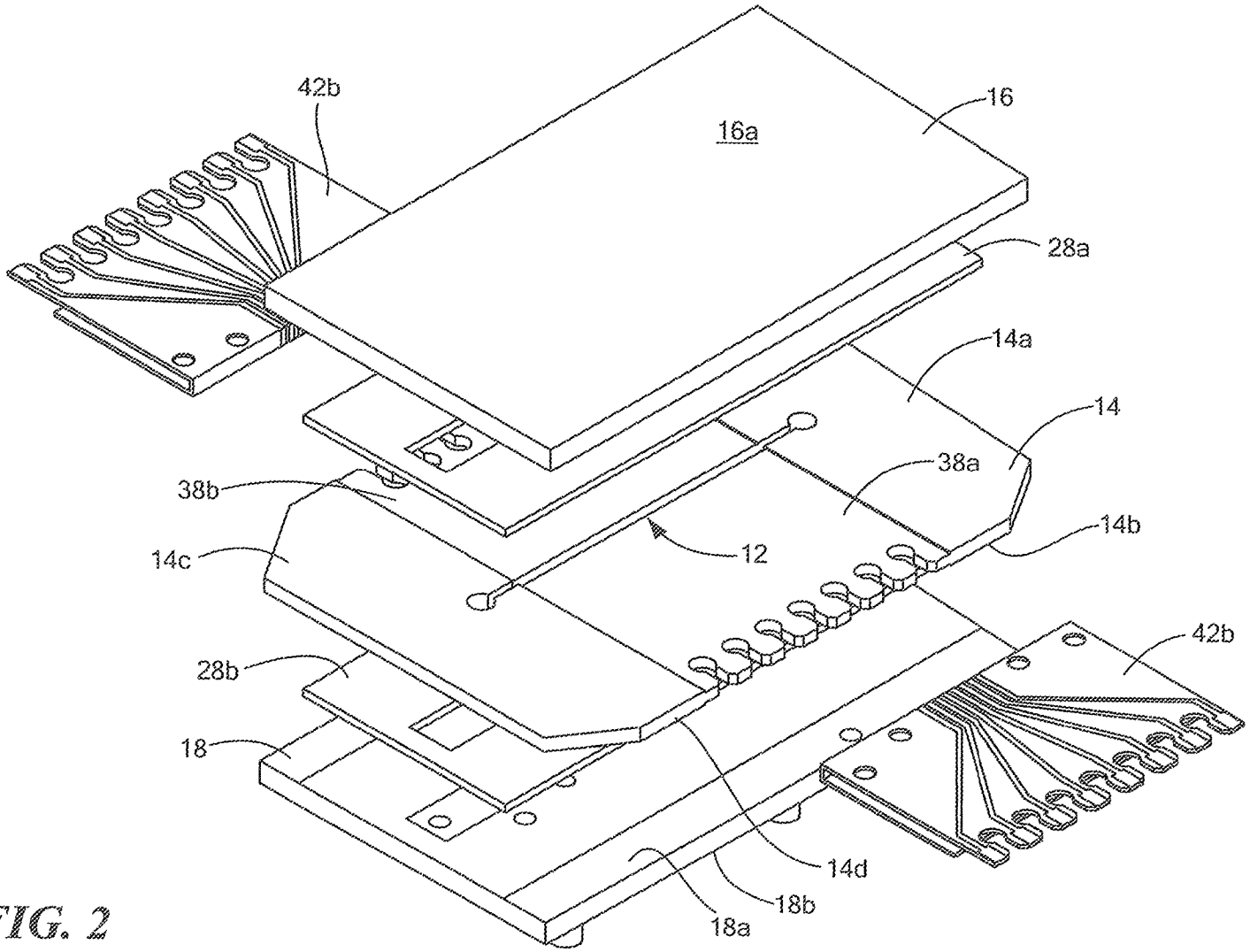
FIG. 2 is an exploded view of the solid state pump system of FIG. 1.

Now referring to FIGS. 1-2, in which like designations represent like elements, a solid state pump 10 includes a first plate 16 (e.g., top plate), a second plate 14 (e.g., middle plate) and a third plate 18 (e.g., bottom plate). The second plate 14 includes a channel 12, electrode circuits 42 and electrodes 50*a*, 50*b*. The second plate may be disposed or otherwise positioned between the first and third plates 16, 18.

In an embodiment, solid state pump 10 may be used to control a flow rate of an electro-rheological (ER) fluid through the channel 12 by applying a varying voltage gradient via electrodes 50*a*, 50*b*, which may be formed as anodes 50*a* and cathodes 50*b*.

In an embodiment, channel 12 may be formed within second plate 12. For example, in some embodiments, channel 12 may be provided as a slot, aperture, bone, duct, or file passage or any void formed or otherwise provided in the second plate. Thus, in an embodiment, first and third plates 16, 18 may form a top surface and a bottom surface, respectively, of the channel 12 when the first, second and third plates 16, 14, 18 are coupled together.

Channel 12 may be formed in a variety of different portions of second plate 14. For example, in one embodiment, channel 12 may be formed within a middle portion of second plate 14. In other embodiments, channel 12 may be offset from a middle portion of second plate 12. The positioning of channel 12 may be selected based at least in part on a particular application of solid state pump 10. In some embodiments, multiple channels 12 may be formed. For example, two or more channels may be formed in at least one of first, second and third plates 16, 14, 18. In other embodiments, one channel 12 may be formed in two or more plates (e.g., first, second and third plates 16, 14, 18). In still other embodiments, solid state pump 10 may include multiple second plates 14. For example, second plate 14 may include multiple layers and a channel 12 may be formed in each of the layers. In an embodiment, the multiple layers of second plate 14 may be stacked together and thus disposed between first and third plate 16, 18. The channel 12 will described in greater detail below with respect to FIGS. 3-3D below.

In an embodiment, electrodes 50*a*, 50*b* may be disposed along a first and second opposing edges 14*c*, 14*d* of second plate 14. The electrodes 50*a*, 50*b* may be coupled to electrode circuits 42 to provide an electric field voltage across channel 12. For example, the electrode circuits 42 may electrically couple electrodes 50*a*, 50*b* to a portion of channel 12. Thus, electrode 50*a*, 50*b* may form one end of an electrode circuit 42 and the portion of the channel may form a second end of the electrode circuit 42. For example, in one embodiment, a first group of electrodes 50*a* may be disposed along the first edge 14*c* and be coupled to a first circuit 40*a* to form an anode portion. A second group of electrodes 50*b* may be disposed along the second edge 14*d* and be coupled to a second electrode circuit 42*b* to form a cathode portion. Thus, first and second group of electrodes 50*a*, 50*b* may provide a varying voltage gradient across the channel 12 via the first and second electrode circuits 42*a*, 42*b*. In an embodiment, the electrode circuits 42 may include flexible printed circuit boards.

In an embodiment, a flow rate of the ER fluid in and/or through channel 12 can be controlled by applying a varying voltage gradient to the first and second group of electrodes 50*a*, 50*b* (e.g., anodes and cathodes 50*a*, 50*b*). In response to the voltages applied to the electrodes, an electric field is established across channel 12. In the presence of such an applied electric field voltage, chains of solid particles within the ER fluid can be aligned within channel 12 between the electrodes 50*a*, 50*b* on each side of the channel 12. As the applied electric field voltage varies, the formed chains of particles can move along a length of channel 12. Thus, the ER fluid can be moved by the force of applied electric field voltage, dipole-dipole interaction, and drag, such that the ER fluid moves from a first end of channel 12 to a second end of channel 12 and can be circulated from an inlet (not shown) of solid state pump 10 to an outlet (not shown) of solid state pump 10.

In an embodiment, an inlet may be formed in at least one of the first, second or third plates 16, 14, 18. For example, the inlet may be formed in a top surface or a side surface of first plate 16. The inlet may be formed in a side surface of second plate 14. In some embodiments, the inlet may be formed in a bottom surface or a side surface of third plate 18. The inlet may be fluidly coupled to a first end of channel 12, for example, to provide ER fluid to channel 12.

In an embodiment, an outlet may be formed in at least one of the first, second or third plates 16, 14, 18. For example, the outlet may be formed in a top surface or a side surface of first plate 16. The outlet may be formed in a side surface of second plate 14. In some embodiments, the outlet may be formed in a bottom surface or a side surface of third plate 18. The outlet may be fluidly coupled to a second end of channel 12, for example, to receive ER fluid to channel 12 being discharged from channel 12.

In some embodiments, a means for coupling 28*a*, 28*b* may be disposed between the first, second and/or third plates 16, 14, 18 to couple one or more of first, second and/or third plates 16, 14, 18 together. For example, in one embodiment, a first means for coupling 28*a* may be disposed between first plate 16 and second plate 14 and a second means for coupling 28*b* may be disposed between second plate 14 and third plate 18. In some embodiment, a means for coupling 28*a*, 28*b* may be used to couple at least one of electrode circuit 42 to a first and/or second surface of second plate 14, which will be discussed in greater detail below with respect to FIG. 3.

In an embodiment, the means for coupling 28*a*, 28*b* may be used to seal a junction between two surfaces (e.g., between two surfaces of first, second, and/or third plates 16, 14, 18 and/or channel 12). In some embodiments, the means for coupling may be used to adhere two surfaces together (e.g., between two surfaces of first, second and/or third plates 16, 14, 18). For example, in one embodiment, each of the first, second and third plates 16, 14, 18 may include one or more threaded holes such that a screw may be inserted through the one or more threaded holes to couple the first, second and third plate 16, 14, 18 together. The one or more threaded holes may be formed through any surface and/or side edge of the first, second and/or third plates 16, 14, 18.

The means for coupling 28*a*, 28*b* may include but is not limited to various types of gaskets, (e.g., a solid gasket or a liquid gasket), mechanical couplings, fasteners (e.g., nuts, bolts, screws, threaded holes, etc.), adhesive material (e.g., double sided tape) or adhesive liquid. In some embodiments, solid state pump 10 may use two or more different types of means for coupling. For example, in one embodiment, a first type of means for coupling may be used to secure the first, second and/or third plates 16, 14, 18 together and a second type of a means for coupling may be used to adhere the first and second electrode circuits 42*a*, 42*b* to one or more surfaces of the second plate 14.

It should be appreciated that although in the example of FIG. 1, solid state pump 10 is illustrated as having three plates in other embodiments, solid state pump 10 may include a varying number of plates (e.g., one plate, two plates, etc.) For example, in one embodiment, solid state pump 10 may be a single unit (e.g., one plate or one module). In such an embodiment, a channel may be formed within a portion of the single unit solid state pump and be configured to provide an electric field across the channel to move ER fluid from an inlet to an outlet of the single unit solid state pump. One or more circuits may electrically couple electrodes formed at one end of the circuits to the channel. For example, the circuits and/or electrodes may be formed or otherwise disposed within the plate via injection molding. In other embodiments, the circuits and/or electrodes may be formed within the plate using techniques such as three-dimensional (3D) printing. Thus, in each of the different embodiments, solid state pump may operate substantially similar to solid state pump 10 as described herein.

In some embodiments, the solid state pump 10 may include two plates. In such an embodiment, a channel may be formed within a portion of one of plates or into a portion of both plates and be configured to provide an electric field across the channel to move ER fluid from an inlet to an outlet of the single unit solid state pump. Electrodes may be formed or printed along edges of one or both of the plates to the provide the voltage. In other embodiments, the solid state pump 10 may include a plurality of plates. The channel 12 may be formed within one of the plates or within a portion of two or more plates. Further, multiple channels 12 may be formed in on or more of the plurality of plates. In each of the different embodiments, solid state pump may operate substantially similar to solid state pump 10 as described herein.

Figure 1A:
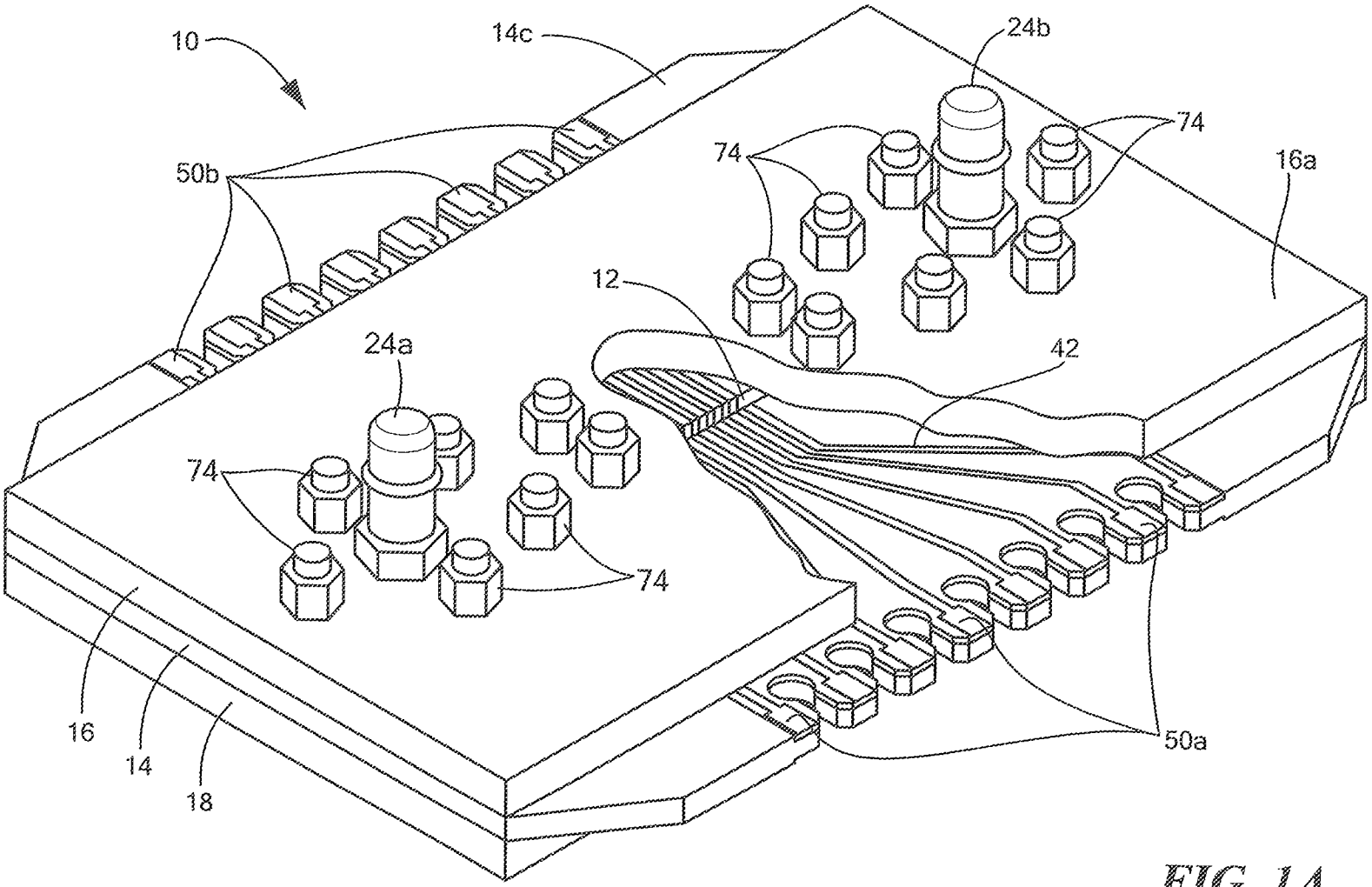
FIG. 1A is an isometric view of a solid state pump system of FIG. 1 having fluid paths coupled to an inlet and outlet.
Figure 1B:
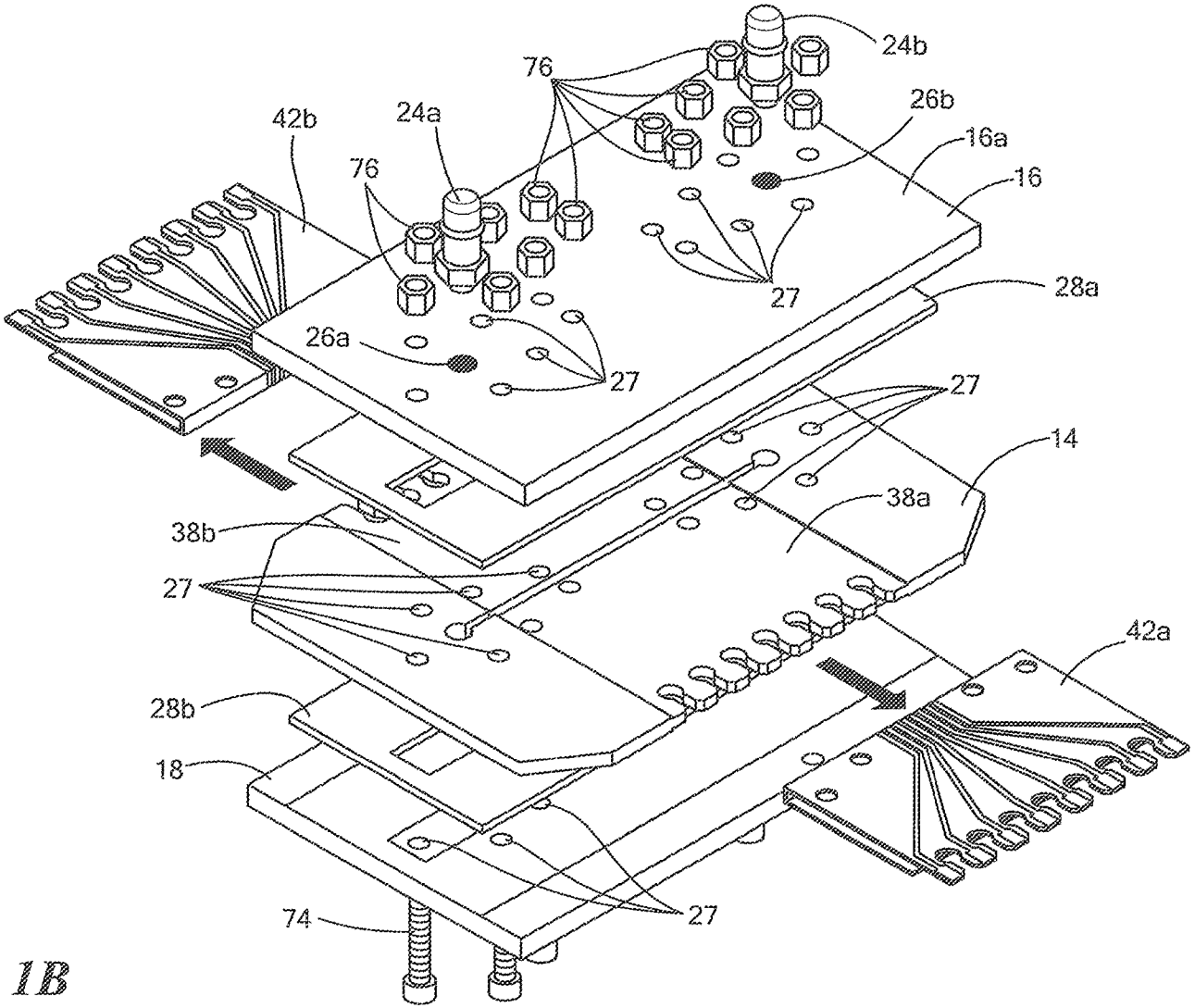
FIG. 1B is an exploded view of the solid state pump system of FIG. 1A having tubes coupled to an inlet and outlet.

In some embodiments, a first and second tube 24*a*, 24*b* may be coupled to the top surface 16*a* of first plate 16 to provide and receive the ER fluid being pumped through channel 12. For example, and briefly referring to FIGS. 1A-1B, first tube 24*a* may be coupled to the top surface 16*a* of first plate 16 and second tube 24*b* may be coupled to the top surface 16*a* of first plate 16. In an embodiment, the first tube 24*a* can be fluidly coupled to a first end of channel 12 through a first opening 26*a* formed in the top surface 16*a* to provide ER fluid to channel 12. Second tube 24*b* may be fluidly coupled to a second end of channel 12 through a second opening 26*b* formed in the top surface 16*a* to receive ER fluid from channel 12.

In some embodiments, the first and second openings 26*a*, 26*b* may be threaded holes formed through a respective surface of first, second and/or third plates 16, 14, 18, such that tube fittings can be screwed to the respective plate. Other techniques, may of course also be used to mount or otherwise couple tubes to ones of the plates.

In an embodiment, a means for coupling may be used to couple the first and second tubes 24*a*, 24*b* to the top surface 16*a* of the first plate 16. For example, in one embodiment, the means for coupling may include instant-bonding adhesive that can be applied to a surface of first and second tubes 24*a*, 24*b* as well as to an inner surface of first and second openings 26*a*, 26*b* to ensure a liquid tight seal.

In some embodiments, a means for coupling 76 may be used to couple the first, second and third plates 16, 14, 18 together. For example, a plurality of openings 27 may be formed in each of first, second and third plates 16, 14, 18. A first type of means for coupling 74 (e.g., screw) may be inserted through each of the openings 27 and fastened with a second type of means for coupling 76 (e.g., nut) to secure the first, second and third plates 16, 14, 18 together.

In an embodiment, at least portions of first, second and third plates 16, 14, 18 may be provided form a dielectric material or other non-conducting material. In one embodiment, each or portions of first, second and third plates 16,14, 18 may include transparent acrylic sheets. The first, second and third plates 16,14, 18 may include the same materials.

In other embodiments, one or more of first, second and third plates 16,14, 18 may include different materials.

Figure 3:
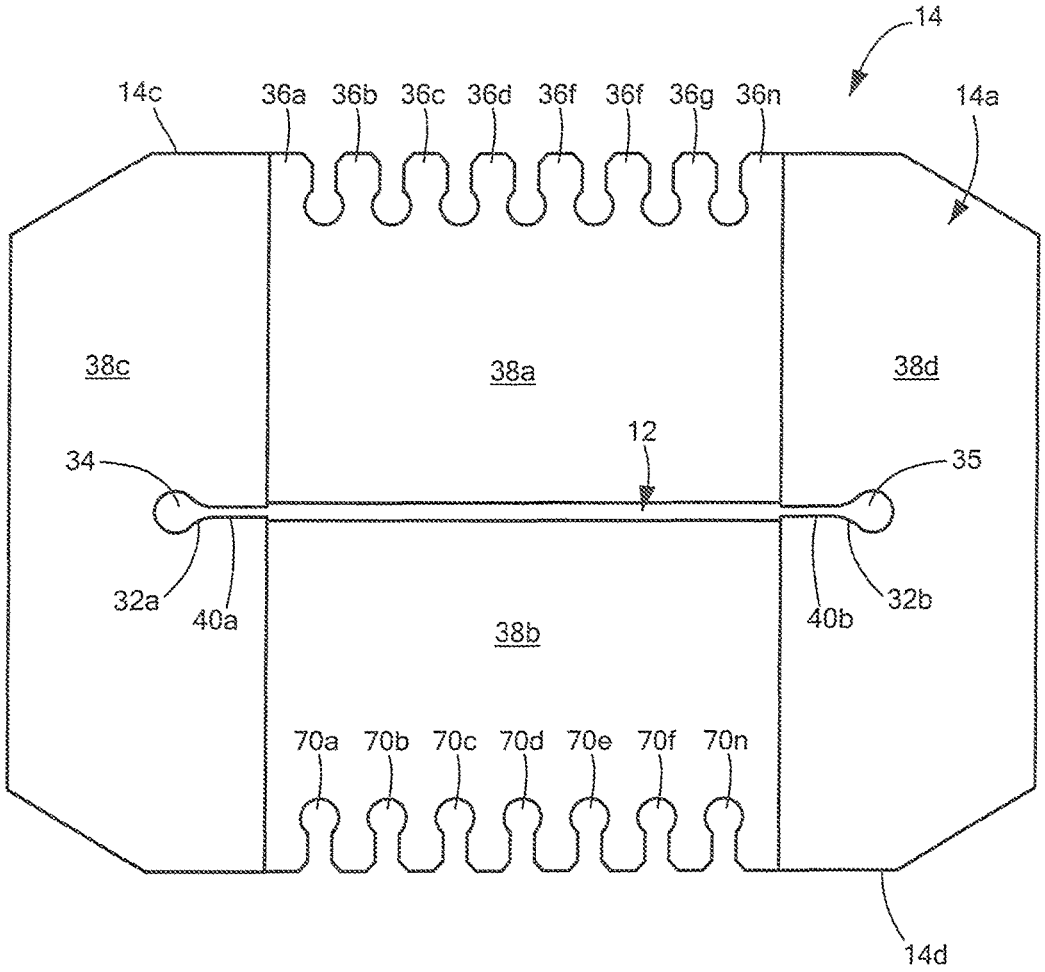
FIG. 3 is a top view of a surface of a middle plate of the solid state pump system of FIG. 1.

Now referring to FIG. 3, a top surface 14*a* (e.g., first surface) of second plate 14 includes channel 12 having an inlet 34*a* formed at a first end and outlet 34*b* formed at a second end. The top surface 14*a* further includes two recessed regions 38*a*, 38*b* and two non-recessed regions 38*c*, 38*d*. In an embodiment, recessed regions 38*a*, 38*b* may be formed into a surface (e.g., top surface and/or bottom surface) of second plate 14 to accommodate a circuit, such as electrode circuit 42 of FIG. 1, such that after the circuit has been disposed on the surface, a surface of the circuit is substantially flush with a surface of the non-recessed regions 38*c*, 38*d*.

Figure 3A:
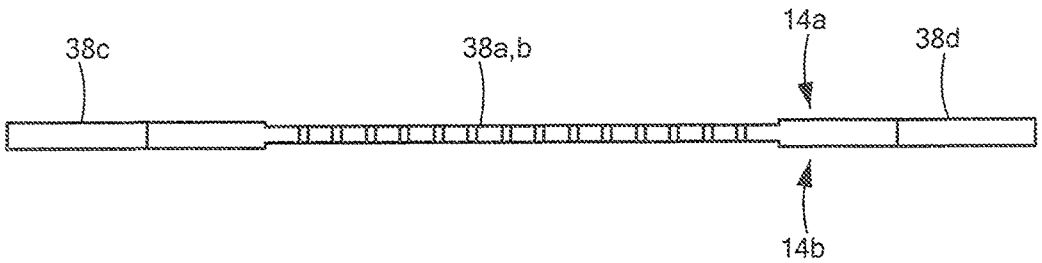
FIG. 3A is a side view of the middle plate of FIG. 3.

For example, and referring briefly to FIG. 3A, a side view of second plate 14 illustrates recessed regions 38*a*, 38*b* and non-recessed regions 38*c*, 38*d* formed or otherwise provided on both a top surface 14*a* and a bottom surface 14*b* of second plate 14. It should be appreciated that recessed regions 38*a*, 38*b* can be formed on the top surface 14*a*, bottom surface 14*b* or both the top and bottom surfaces 14*a*, 14*b* of second plate 14 to accommodate electrode circuits that may be disposed on, wrapped around, or otherwise formed on each of the respective surfaces. In some embodiments, recessed regions 38*a*, 38*b* may be etched on the both sides of second plate 14 for the flexible circuit to wrap around.

A means for coupling may be used to couple the recessed regions 38*a*, 38*b* to both sides of second plate 14. For example, in one embodiment, the means for coupling may include double sided tape that can be used to ensure the contact (e.g., mechanical contact, electrical contact) of electrode circuit 42 to both sides of second plate 14. The means for coupling may be resistant to oil, for example, when ER fluid is the hydraulic fluid.

A depth of the recessed regions 38*a*, 38*b* may vary. For example, the depth of recessed regions 38*a*, 38*b* may be selected based at least in part on the dimensions (e.g., thickness of a circuit) and/or the dimensions of second plate 14. In some embodiments, a depth of the recessed regions 38*a*, 38*b* may be selected based, at least in part on, a thickness of the means for coupling. In some embodiments, first and third plates 16, 18 may include one or more recessed regions and one or more non-recessed regions. The depth of recessed regions 38*a*, 38*b* on the first and/or third plate 16, 18 may be selected based at least in part on the dimensions (e.g., thickness of a circuit), dimensions of respective plate (e.g., first or third plate 16, 18) and/or a thickness of the means for coupling.

It should be appreciated, that in some embodiments, circuits may be formed within a surface of or otherwise printed directly on a surface of the second plate 14, thus second plate 14 may not have recessed regions 38*a*, 38*b* and instead the top surface 14*a*, bottom surface 14*b* or both the top and bottom surfaces 14*a*, 14*b* of second plate 14 may be flat or substantially flat across the entire respective surface.

Referring back to FIG. 3, in an embodiment, one or more teeth 36*a*-36*n* may optionally be formed along a first and second edge 14*c*, 14*d* of second plate 14. In some embodiments, the one or more teeth 36*a*-36*n* may be formed along an edge of recessed regions 38*a*, 38*b*. Each of the one or more teeth 36*a*-36*n* may be formed to couple to an electrode to the respective side of second plate 14. The electrodes can be coupled to an independent power source to provide a voltage to the respective circuit deposed on or otherwise formed on a surface of second plate 14. In an embodiment, arc region 70*a*-70*n* may be formed between each of the teeth 36*a*-36*n*.

In some embodiments, a spacing between each of the teeth 36*a*-36*n* may be equal. In other embodiments, the spacing between one or more teeth 36*a*-36*n* may be different. The number of teeth formed along the first and/or second edge 14*c*, 14*d* may vary based at least in part on a particular application of solid state pump 10, dimensions of solid state pump and/or second plate 14. In some embodiments, the number of teeth formed along the first and/or second edge 14*c*, 14*d* may be selected to equal a number of electrodes to be coupled to second plate 14.

In the illustrative embodiment of FIG. 3, channel 12 can be formed in a middle portion of second plate 14. However, it should be appreciated that channel 12 may formed in any portion of second plate 14. For example, in some embodiments, channel 12 may be formed such that it is offset with respect to a middle portion of second plate 14. In some embodiments, second plate 12 may include multiple channels 12.

Figure 3B:
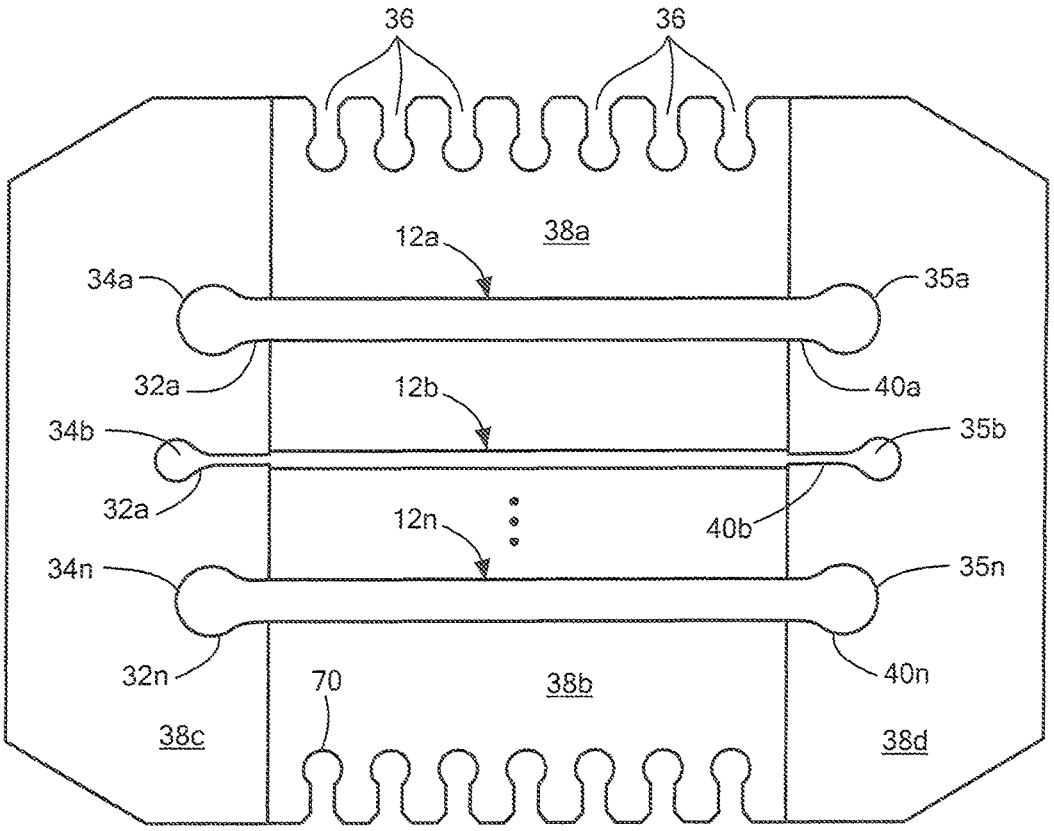
FIG. 3B is a top view of a surface of a middle plate of the solid state pump system of FIG. 1 having a plurality of channels.

For example, and referring to FIG. 3B, a plurality of channels 12*a*-12*n* may be formed in second plate 14. In an embodiment, each of channels 12*a*-12*n* may include a circuit coupled to at least two opposing sides of the respective channel to provide an electric field voltage across the respective channel to move ER fluid from the first end to the second end of the respective channel. Each of the channels 12*a*-12*n* may include and inlet 34*a*-34*n* formed at a first end and an outlet 35*a*-35*n* formed at a second end. In some embodiments, the channels 12*a*-12*n* may be equally spaced apart from each other. In other embodiments, the spacing between one or more channels 12*a*-12*n* may vary.

In some embodiments, each of the channels 12*a*-12*n* may have the same dimensions (e.g., length, width) and/or shape (e.g., straight, curved, etc.). In other embodiments, the dimensions (e.g., length, width) and/or shape (e.g., straight, curved, etc.) may vary from one channel to a next.

Figure 3C:
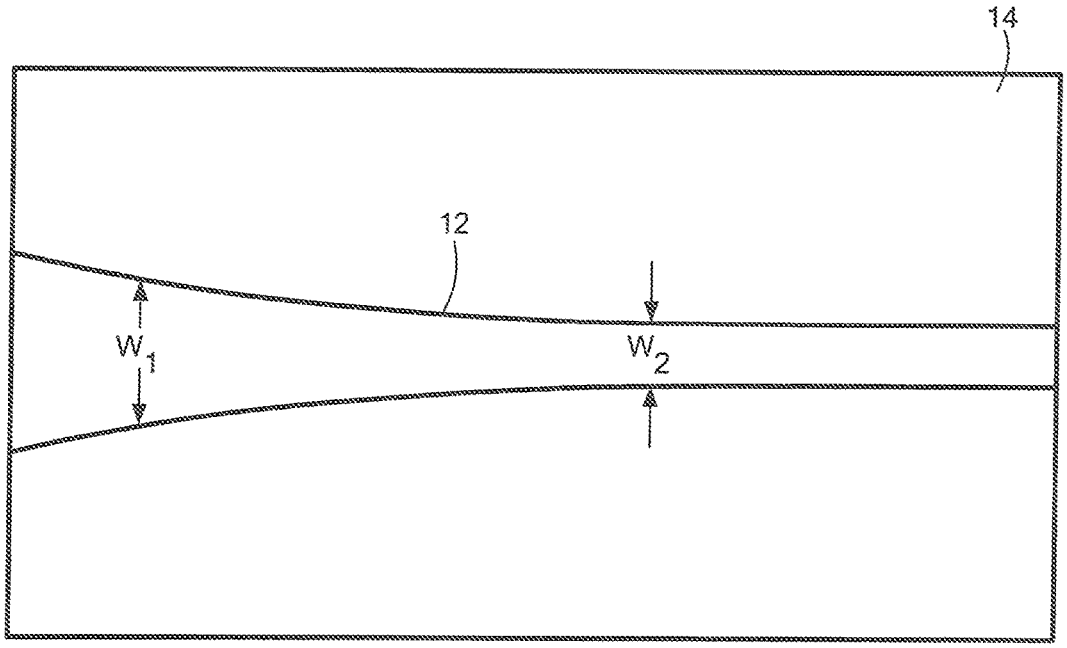
FIG. 3C is a top view of a surface of a middle plate of the solid state pump system of FIG. 1 having a channel with a varying width.
Figure 3D:
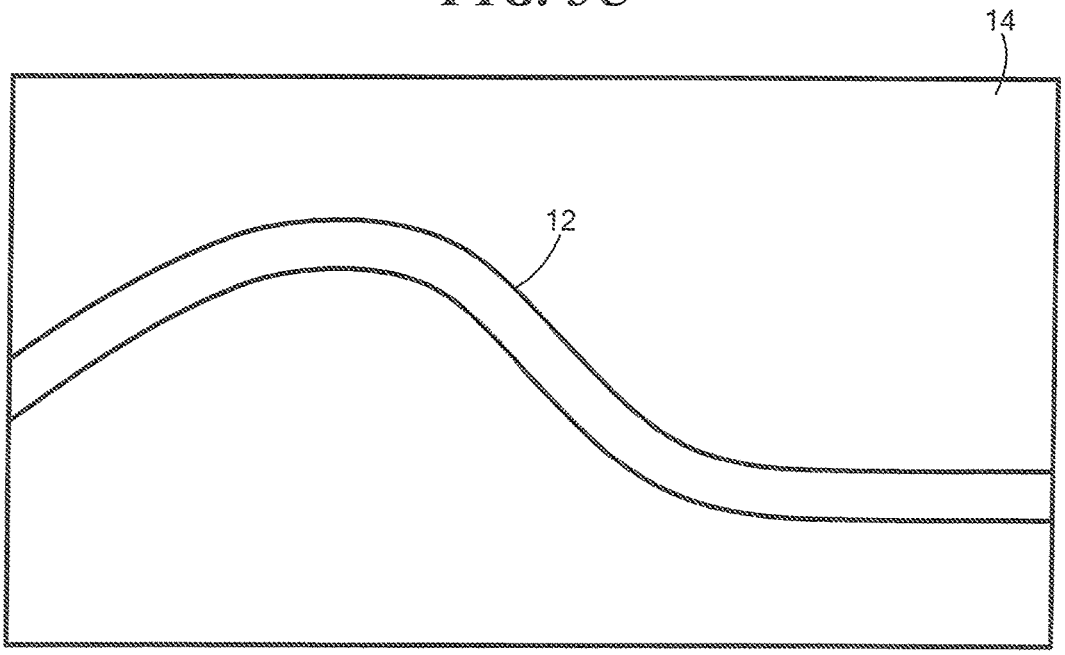
FIG. 3D is a top view of a surface of a middle plate of the solid state pump system of FIG. 1 having a channel with an alternate shape.

For example, and referring to FIG. 3C, in some embodiments, a width of channel 12 may vary from a first end to a second end. For example, and as illustrated in FIG. 3C, channel 12 may have a first width, W1, at the first end that is greater than a second width, W2, at the second end (e.g., W1>W2). Thus, the width may decrease along a length of channel 12. In other embodiments, the first width, W1, at the first end may be less than the second width, W2, at the second end (e.g., W1<W2). Thus, the width may increase along a length of channel 12. With such an approach a constant voltage applied to electrodes results in varied electric field along the channel. That is for the same applied voltage, the electric field magnitude across a narrow portion of the channel will be greater than an electric field magnitude at a wide portion of the channel.

Channel 12 may be formed in a variety of different shapes. For example, and referring to FIG. 3, channel 12 can be formed having a substantially straight shape. However, and now referring to FIG. 3D, in some embodiments, channel 12 may have a curved shape. It should be appreciated that a shape of channel 12 (e.g., straight, curved, etc.) may be selected based at least in part on the shape of second plate 14 and/or a particular application of solid state pump 10.

In some embodiments, a fillet 32 can be used connect channel 12 and the inlet 34 and outlet 35 to reduce the pressure loss to a minimum. In an embodiment, the flow rate of solid state pump 10 can be determined based, at least in part, on the dimensions of second plate 14, channel 12 and a magnitude of the electric field voltage applied across channel 12. For example, a thickness of second plate 14 may impact the flow rate of ER fluid through channel 12. Further, a width of channel 12 may be selected (e.g., limited) based on the magnitude of applied electric field voltage. In some embodiments, an edge of second plate 14 may be modified (e.g., dented) to aid in sealing channel 12 and provide better insulation.

In an embodiment, a stair-step 40 may be used at the first and/or second end of channel 12 (e.g., next to inlet 34 and/or outlet 35, respectively) to provide a uniform width of channel 12 after wrapping the electrode circuit 42 through the channel and around second plate 14.

Figure 4:
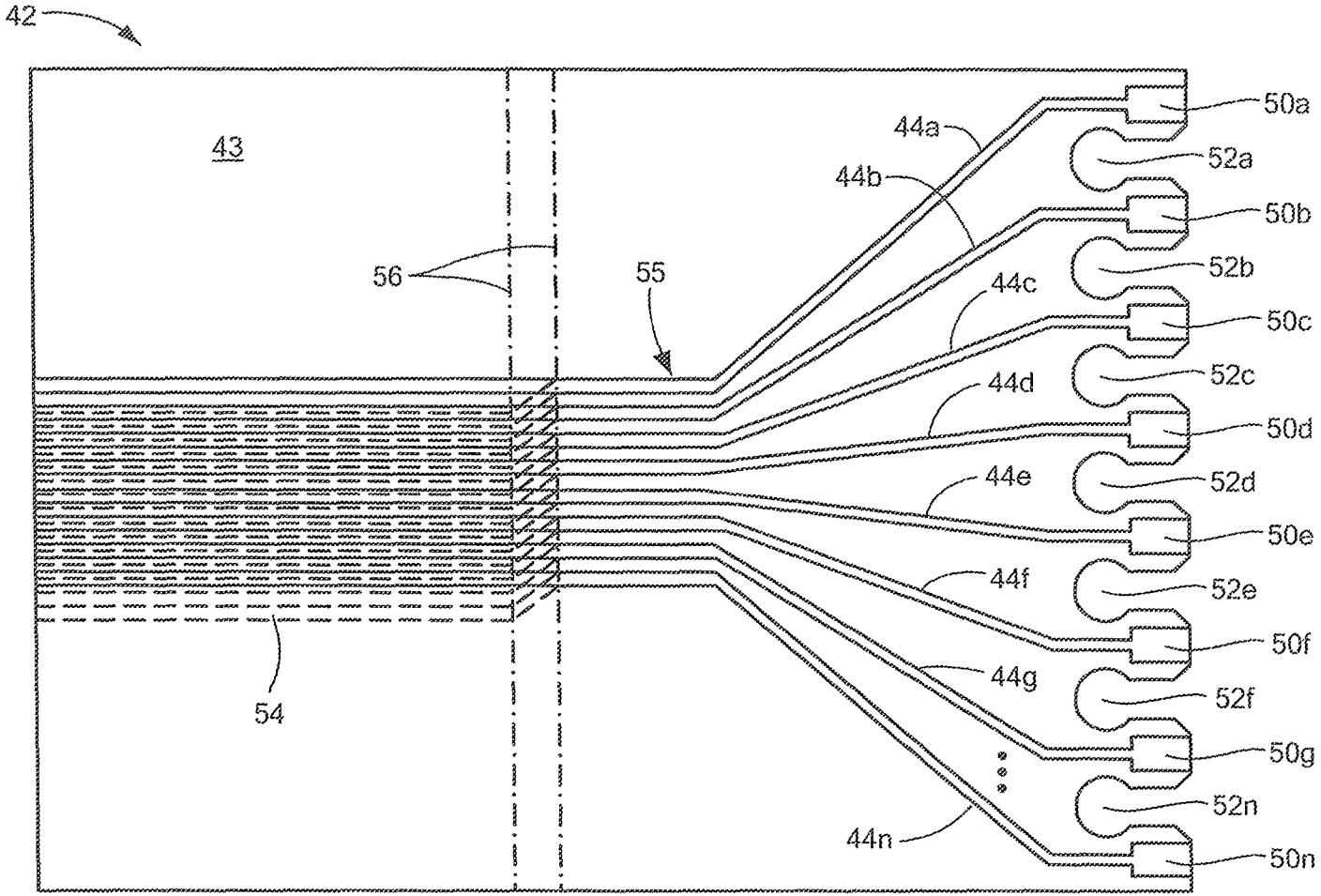
FIG. 4 is a top view of an unfolded circuit.

Now referring to FIG. 4, electrode circuit 42 includes one or more electrodes 44*a*-44*n* formed on a surface 43 of the electrode circuit 42. In one embodiment, electrode circuit 42 may be a printed circuit board and include conducting materials, such as conductive tracks, pads and other features etched from conductive material and disposed onto a non-conductive substrate. Each of the electrodes 44*a*-44*n* may include an electrode end 50*a*-50*n* to couple to a power source. In some embodiments, a spacing between each of the electrodes 44*a*-44*n* may be equal. In other embodiments, the spacing between one or more of the electrodes 44*a*-44*n* may be different. In an embodiment, the spacing of the one or more of the electrodes 44*a*-44*n* may be selected based at least in part on a desired magnitude of an electric field voltage to be generated and applied across channel 12. For example, to lower the electric field voltage, the spacing between electrodes 44*a*-44*n* can be decreased or minimized and to increase the electric field voltage, the spacing between electrodes 44*a*-44*n* can be increased or maximized.

In an embodiment, the number of electrodes 44*a*-44*n* formed on the surface 43 of electrode circuit 42 may vary based at least in part on dimensions of electrode circuit 42 and/or dimensions of a plate that electrode circuit 42 is to be coupled to. In some embodiments, the number of electrodes 44*a*-44*n* formed on the surface 43 of electrode circuit 42 may be selected based at least in part on the desired magnitude of an electric field voltage to be generated and applied across channel 12. For example, the number of electrodes 44*a*-44*n* can be increased to increase the maximum pressure differential requirement across the channel and decreased to decrease the maximum pressure differential requirement across the channel 12.

In an embodiment, a pattern of the electrodes 44*a*-44*n* may vary based at least in part on a spacing requirement between each of the electrodes 44*a*-44. The electrodes 44*a*-44*n* may formed in a symmetric pattern or an asymmetric pattern. For example, and as illustrated in FIG. 4, electrode portions 44*a*-44*n* may have a radial pattern 55 to provide desired spacing for the electrodes pads 50*a*-50*n* (e.g. to facilitate electrical connection between pads 50*a*-50*n* and other circuitry (e.g. a voltage source)). In other embodiments, the electrode portions 44*a*-44*n* may be formed in a straight line pattern 54. Those of ordinary skill in the art will appreciate how to select a pattern in which to provide electrode portions 44*a*-44*n* to meet the needs of a particular application.

In some embodiments, a width of each of the electrode ends 50*a*-50*n* may vary depending on dimensions of a power supply to be coupled to the electrode ends 50*a*-50*n*. For example, the widths of each of the electrode ends 50*a*-50*n* may be increased or decreased based at least in part on the dimensions of a power supply and/or to ensure a stronger connection to the power supply. In some embodiments, the width of each of the electrode ends 50*a*-50*n* may be the same. In other embodiments, the width of one or more of the electrode ends 50*a*-50*n* may be different.

In some embodiments, an edge of electrode circuit 42 may be indented to ensure a better insulation (e.g., better coupling) between at least two of the electrodes 44*a*-44*n*. For example, an edge of electrode circuit 42 may be indented or otherwise grooved or shaped to receive the electrodes 44*a*-44*n*.

In some embodiments, arcs 52*a*-52*n* may be formed between each of the electrode ends 50*a*-50*b*. The arcs 52*a*-52*n* may be by a means for coupling to couple first, second and/or third plates 16, 14, 18 together. For example, in one embodiment, a screw and/or nut may be used to couple first, second and/or third plates 16, 14, 18 together and the screw may be disposed through each of the arcs 52*a*-52*n* and through second plate 14.

In an embodiment, double-dashed line 56 (i.e., fold line) represents a folding line of electrode circuit 42 where electrode circuit 42 can be folded to wrap through a channel and around second plate 14. Thus, as illustrated in FIG. 5 to be discussed below the electrode circuit 42 may be disposed on both, a top and bottom surface, of second plate 14.

Figure 5:
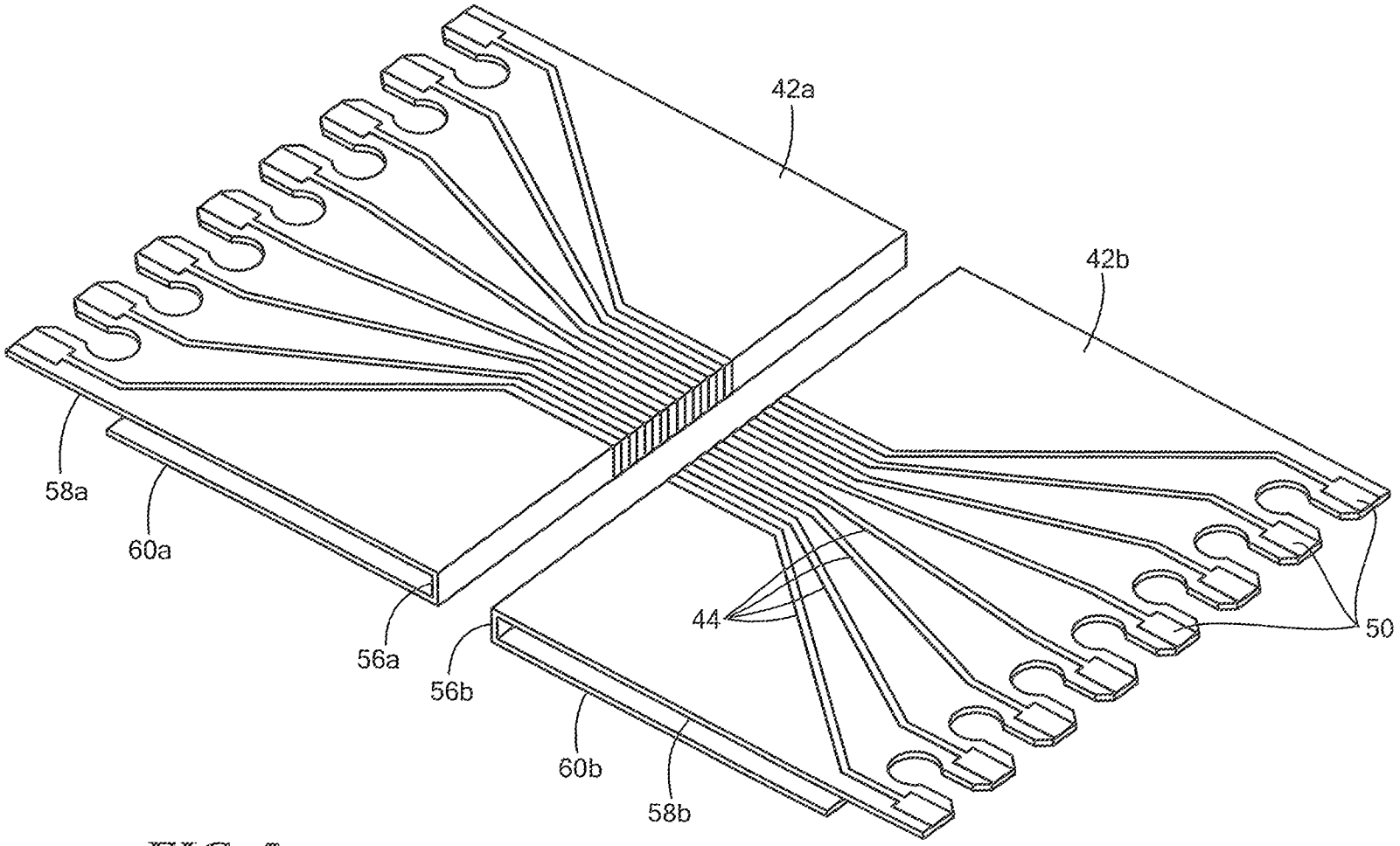
FIG. 5 is a perspective view of two folded circuits.

Now referring to FIG. 5, first and second electrode circuit 42*a*, 42*b* each include a plurality of electrodes 44*a*-44*n*. It should be appreciated that first and second electrode circuits 42*a*, 42*b* are the same or substantially the same as electrode circuits 42 described above with respect to FIG. 4, however first and second electrode circuits 42*a*, 42*b* are illustrated in a folded position. For example, first and second electrode circuits 42*a*, 42*b* can be folded at each of their respective folding lines 56*a*, 56*b* (FIG. 4). In an embodiment, folding lines 56*a*, 56*b* correspond to folding line 56 of electrode circuit 42 of FIG. 4.

In an embodiment, folding lines 56*a*, 56*b* are positioned on first and second electrode circuits 42*a*, 42*b* based at least in part on a geometry of the second plate 14 and a recessed region formed on the second plate 14. For example, in a folded position, first and second electrode circuits 42*a*, 42*b* may each have a top portion 58*a*, 58*b*, respectively and a bottom portion 60*a*, 60*b*, respectively.

In some embodiments, a length of the first top portion 58*a* may be equal to a length of the recessed region formed on the first electrode circuit 42*a* and a length of the top portion 58*b* may be equal to a length of the recessed region formed on the second electrode circuit 42*a*. A length of first and second bottom portions 60*a*, 60*b* may be less than the length of first and second top portions 58*a*, 58*b*, respectively. For example, in some embodiments, a length of the first bottom portion 60*a* may be equal to a difference between the length of the first top portion 58*a* and a length to couple to a power supply and a length of the second bottom portion 60*b* may be equal to a difference between the length of the second top portion 58*b* and a length to couple to a power supply. For example, first and second top portions 58*a*, 58*b* may extend beyond first and second bottom portions 60*a*, 60*b*, respectively, to enable a connection to the power supply.

Figure 6:
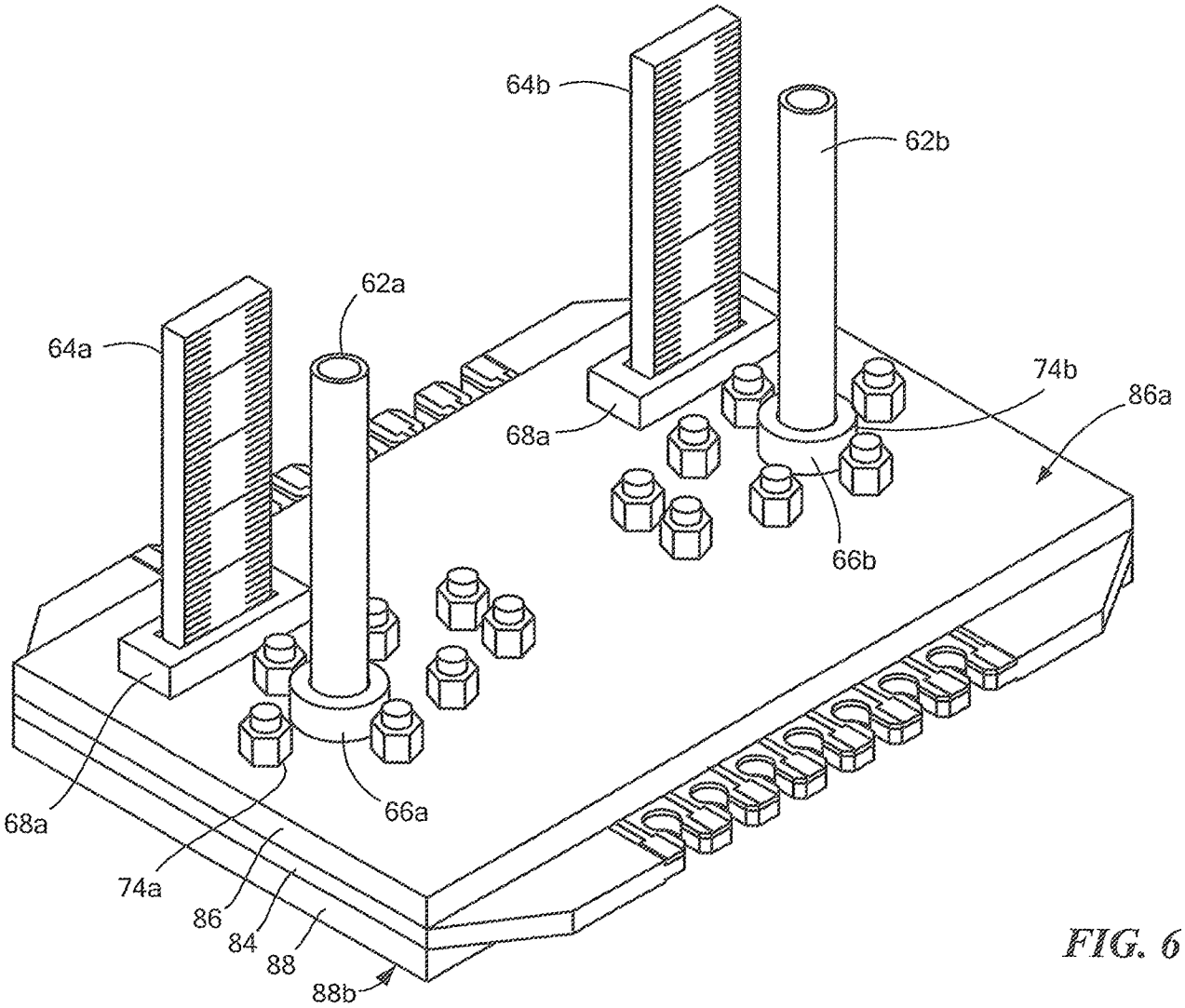
FIG. 6 is an isometric view of a solid state pump system with pitot tubes and graduated scales.

Now referring to FIG. 6, a solid state pump 60 includes a first, second and third plates 86, 84, 88, first and second scales 64*a*, 64*b* and first and second pressure measurement devices 62*a*, 62*b*. In an embodiment, first, second and third plates 86, 84, 88 may the same or substantially similar to first, second and third plates 16, 14, 18 described above with respect to FIGS. 1-5. Further, solid state pump 60 may be the same or substantially similar to solid state pump 10 described above with respect to FIGS. 1-5, however, solid state pump 60 includes first and second pressure measurement devices 62*a*, 62*b* to measure a pressure differential between an inlet 74*a* and outlet 74*b*.

In an embodiment, the first pressure measurement devices 62*a* may be coupled to inlet 74*a* using a base 66*a* and second pressure measurement devices 62*b* may be coupled to outlet 74*b* using a second base 66*b*. First and second pressure measurement devices 62*a*, 62*b* may include any type of pressure measure device. For example, and as illustrated in FIG. 6, first and second pressure measurement devices 62*a*, 62*b* may include pitot tubes. In some embodiments, the first and second pressure measurement devices 62*a*, 62*b* may be used as a substitute for tube fittings to provide ER fluid to the solid state pump 60 via the inlet 74*a* and receive ER fluid from the solid state pump 60 via the outlet 74*b*.

Solid state pump 60 may include first and second scales 64*a*, 64*b* to measure a height of first and second pressure measurement devices 62*a*, 62*b*. For example, in one embodiment, first and second scales 64*a*, 64 may include graduated scales and can be aligned with first and second pressure measurement devices 62*a*, 62*b* in parallel to measure the height of the surface of ER fluid in the first and second pressure measurement devices 62*a*, 62*b*. It should be appreciated that although FIG. 6 illustrates first and second scales 64*a*, 64 as graduated scales, that other types of pressure measurement devices and scales may be used based on a particular application and/or design of solid state pump 60.

In some embodiments, the height of the surface of ER fluid in the first and/or second pressure measurement devices 62*a*, 62*b* may change responsive to a voltage gradient being applied to a channel within solid state pump 60 that causes the ER fluid to flow from the inlet 74*a* to the outlet 74*b*. The height of the first and second pressure measurement devices 62*a*, 62*b* and/or first and scales 64*a*, 64 can be determined by a specific varying voltage gradient applied to the electrodes disposed on or otherwise formed on at least one of first, second or third plates 86, 84, 88. In an embodiment, a difference of the height of the fluid surfaces in first and second pressure measurement devices 62*a*, 62*b* indicates the pressure differential.

In the illustrative embodiment of FIG. 6, the first pressure measurement devices 62*a* may be coupled to inlet 74*a* formed on a top surface 86*a* of first plate 86 using the first base 66*a* and second pressure measurement devices 62*b* may be coupled to outlet 74*b* formed on the top surface 86*a* of first plate 86 using the second base 66*b*. Further, first scale 64*a* may be coupled to the top surface 86*a* of first plate 86 using a first base 68*a* and second scale 64*b* may be coupled to the top surface 86*a* of first plate 86 using a second base 68*b*. However, it should be appreciated that the inlet 74*a* and outlet 74*b* may be formed on any surface and/or side edge of the solid state pump 60 (e.g., any surface or side edge of first, second and third plates 86, 84, 88). For example, in one embodiment, inlet 74*a* may be formed on the top surface 86*a* of first plate 86 and the outlet 74*b* may be formed on a bottom surface 88*b* of third plate 88. Thus, first and second pressure measurement devices 62*a*, 62*b* and first and second scales 64*a*, 64*b* may be formed on any surface and/or side edge of the solid state pump 60 (e.g., any surface or side edge of first, second and third plates 86, 84, 88).

Figure 7:
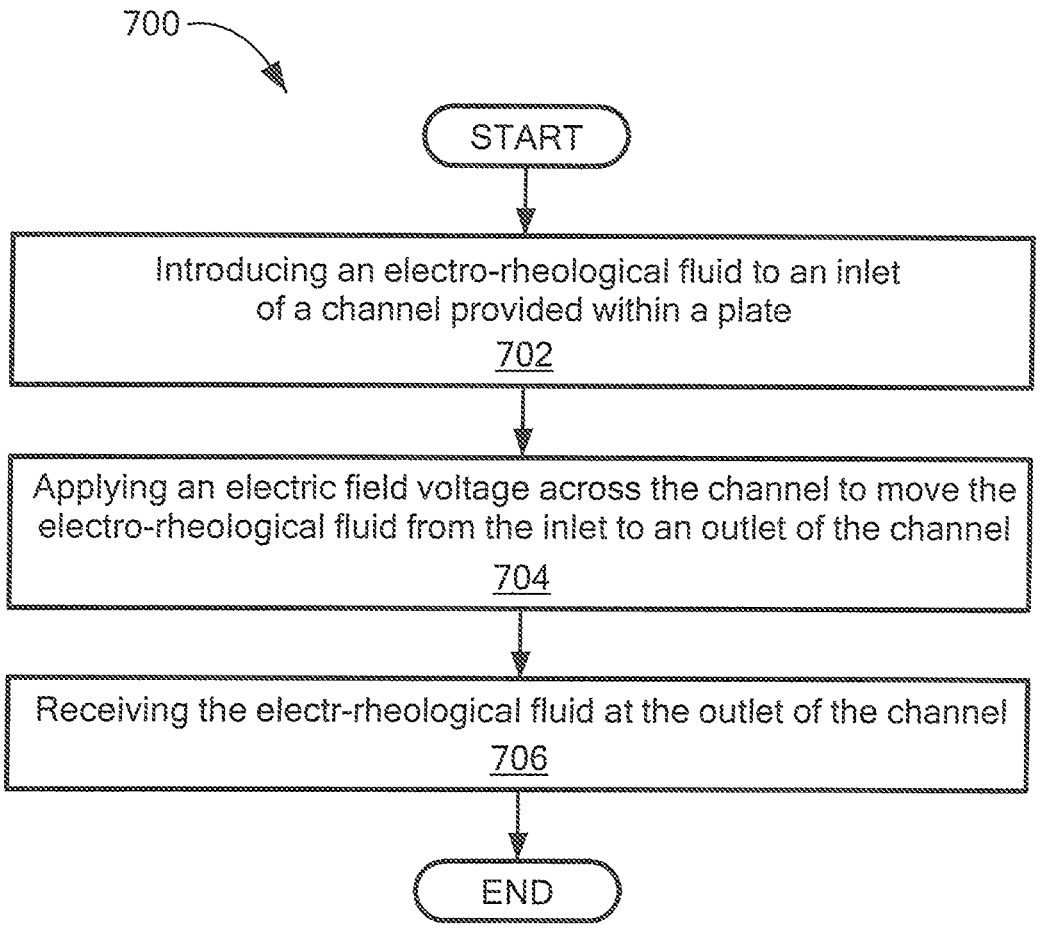
FIG. 7 is a flow diagram of a method for pumping fluid using a solid state pump system.

Now referring to FIG. 7, a method 700 for pumping ER fluid through a solid state pump begins at block 702, whereby ER fluid can be introduced into one or more channels formed within a solid state pump.

The ER fluid may be provided to an inlet coupled to a first end of the channel. Thus, the channel may have a first end fluidly coupled to an inlet of the solid state pump and a second end fluidly coupled to an outlet of the solid state pump. In some embodiments, a first tube may be coupled to the inlet and be fluidly coupled to the first end of the channel. The first tube may provide the ER fluid to the first end of the channel. Further, a second tube may be coupled to the outlet and be fluidly coupled to the second end of the channel. The second tube can receive the ER fluid after the ER fluid has been pumped through the solid state pump.

At block 704, an electric voltage may be applied across the channel to move the electro-rheological fluid from the inlet to an outlet of the channel. In an embodiment, one or more circuits may electrically couple electrodes to a portion of the channel to provide a varying voltage to the channel. For example, in one embodiment, a spatially varying horizontal electric field may be applied across the channel. In other embodiments, a spatially varying vertical electric field may be applied across the channel.

The electric field voltage can change a property of the ER fluid to move the ER fluid from the first end of the channel to the second end of the channel and thus, from the inlet to the outlet of the solid state pump.

In an embodiment, the electric field voltage can be varied at one or more points along the channel to move the ER fluid from the first end to the second end. For example, the electric field voltage applied across the first end of the channel can be different (e.g., greater than, less than) than the electric field voltage applied across the second end of the channel. In some embodiments, during operation of the solid state pump, the electric field voltage can be continuously varied at different points to generate a wave like response to pump the ER fluid through the channel. A pattern of electric field distribution can be propagated down the channel by the applied voltage. In some embodiments, the electric field to be propagated may not uniform.

In some embodiments, the electric field voltage may be maintained at a constant level and the width of the channel may be varied from first end to the second end to generate a different pressure differential at the first end as compared with the second end of the channel. For example, the width of the channel at the first end may be greater than or less than the width of the channel at the second end. Thus, the electric field applied across the channel may vary based, at least in part on, a width of the respective portion of the channel. In other embodiments, the electric voltage received from an independent source via the circuits and electrodes may be varied and the width of the channel may be varied, thus the electric field voltage applied across the channel may be a result of the both the varied electric voltage and the differing widths of the channel.

In some embodiments, the shape of the channel may be varied (e.g., s-shape, curved shape, etc.), thus the electric field voltage can be varied at one or more points along the channel to move the ER fluid from the first end to the second end.

In an embodiment, the pumping of the ER fluid from the inlet to the outlet may be based at least in part on the applied electric field, dipole-dipole interaction and a drag factor. For example, a first circuit may include a plurality of cathodes and be electrically coupled to a first side of the channel and a second circuit may include a plurality of anodes and be electrically coupled to a second side of the channel.

In an embodiment, the cathodes, first circuit, anodes and second circuit may form a dipole-dipole interaction across the channel to move the ER fluid from the first end to the second end of the channel. In an embodiment, the drag factor may refer to a numerical rate at which the flow rate of the ER fluid is decreasing based at least in part on the dimensions and/or properties of the channel as the ER fluid flows from one end to a second end of the channel. Thus, a flow rate of the ER fluid through the channel can be based, at least in part, on dimensions of the channel (e.g., length, shape, width), properties (e.g., type of material) and a magnitude of the electric field voltage.

In some embodiments, a plurality of electrodes may be coupled to each of the first and second circuits. The plurality of electrodes may be coupled to a power source to provide a voltage to each of the first and second circuits. In an embodiment, a spacing of the plurality of electrodes along a length of the first and/or second circuits respectively can determine a magnitude of the electric field voltage applied across the channel. Thus, the electrodes may be spaced according to a desired electric field to be generated and/or dimensions of the first and second circuits.

At block 706, the ER fluid may be received at the outlet of the channel. The flow rate of the ER fluid through the channel can be based, at least in part, on dimensions of the channel and the magnitude of the applied electric field voltage.

In some embodiments, the solid state pump may include pressure measuring devices to measure a pressure difference between the inlet and the outlet. For example, a first pressure device may be coupled to the inlet and a second pressure device may be coupled to the outlet.

In some embodiments, scales may be coupled to the solid state pump to measure the pressure difference between the inlet and the outlet. For example, in one embodiment, a first graduated scale may be coupled to the solid state pump and aligned with the first pressure measurement device and a second graduated scale may be coupled to the solid state pump and aligned with the second pressure measurement device. The first and second graduate scales can measure a height of the first pressure measurement device and the second pressure measurement device respectively to determine the pressure difference between the inlet and the outlet.

In some embodiments, the solid state pump may include a plurality of channels. Each of the plurality of channels may be formed and operate substantially similar to the channels described above (e.g., channel 12 of FIGS. 1-3D). For example, each of the plurality of channels may include circuits coupled to at least two opposing sides of the respective channel to apply an electric field voltage across them. In such an embodiment, the solid state pump may include a plurality of inlets and outlets. For example, the solid state pump may include at least one inlet and one outlet for each of the plurality of channels.

While the concepts, systems and techniques sought to be protected have been particularly shown and described with references to illustrated embodiments thereof, it will be understood by those skilled in the art that various changes in form and details may be made therein without departing from the spirit and scope of the concepts as defined by the appended claims.

Elements of different embodiments described herein may be combined to form other embodiments not specifically set forth above. Other embodiments not specifically described herein are also within the scope of the following claims.

What is claimed:

1. A solid state pumping system comprising:

a first plate having first and second opposing surfaces;

a second plate having first and second opposing surfaces, the second plate disposed under the second surface of the first plate, wherein the second plate comprises:

a channel formed within the second plate, the channel having a first end and a second end;

a first circuit coupled to a first side of the channel; and a second circuit coupled to a second side of the channel, wherein in response to a voltage applied thereto, the first and second circuits provide an electric field voltage across the channel such that in response to the electric field voltage an electro-rheological fluid moves from the first end to the second end of the channel; and a third plate having first and second opposing surfaces, the third plate disposed under the second surface of the second plate.

2. The system of claim 1, further comprising a plurality of electrodes coupled to each of the first and second circuits.

3. The system of claim 2, wherein a spacing of the plurality of electrodes along a length of the first and second circuits respectively determines a magnitude of the electric field voltage applied across the channel.

4. The system of claim 3, wherein a flow rate of the electro-rheological fluid through the channel is based, at least in part, on dimensions of the channel and the magnitude of the electric field voltage.

5. The system of claim 1, further comprising a first tube coupled to an inlet formed through a first portion of at least one of the first plate or the third plate and coupled to the first end of the channel, wherein the first tube provides the electro-rheological fluid to the first end of the channel, and a second tube coupled to an outlet formed through a second portion of at least one of the first plate or the third plate and coupled to the second end of the channel, wherein the second tube receives the electro-rheological fluid.

6. The system of claim 1, wherein the second plate comprises a recessed region on each of the first and second surfaces, the recessed region having a shape and dimension selected to accommodate the first and second circuits such that the surfaces of first and second circuits are substantially flush with the non-recessed portions of the first and second surfaces of the second plate.

7. The system of claim 6, further comprising a means for coupling the first and second circuits to the recessed region on the first surface of the second plate and the first and second circuits to the recessed region on the second surface of the second plate.

8. The system of claim 7, wherein a depth of the recessed regions on the first surface of the second plate corresponds to a thickness of the means for coupling and a depth of the recessed regions on the second surface of the second plate corresponds to a thickness of the means for coupling.

9. The system of claim 7, wherein the second surface of the first plate has a first recessed region, the first recessed region having a shape and dimension selected to accommodate the first and second circuits such that the surfaces of first and second circuits are substantially flush with the non-recessed portions of the second surface of the first plate and the first surface of the third plate has a second recessed region, the second recessed region having a shape and dimension selected to accommodate the first and second circuits such that the surfaces of first and second circuits are substantially flush with the non-recessed portions of the first surface of the third plate.

10. The system of claim 9, wherein a depth of the first recessed region on the second surface of the first plate corresponds to a thickness of the means for coupling and a depth of the second recessed region on the first surface of the third plate corresponds to a thickness of the means for coupling.

11. The system of claim 1, wherein the first circuit is wrapped through the channel and coupled to the first and second surfaces of the second plate.

12. The system of claim 1, wherein the second circuit is wrapped through the channel and coupled to the first and second surfaces of the second plate.

13. The system of claim 1, wherein the first circuit includes a plurality of cathodes and the second circuit includes a plurality of anodes to form dipole-dipole interaction across the channel to move the electro-rheological fluid from the first end to the second end of the channel.

14. The system of claim 1, wherein each of the first, second and third plates include transparent acrylic plates.

15. The system of claim 1, wherein the channel is a first one of a plurality of channels formed within the second plate, wherein the electric field voltage is applied across each of the plurality of channels.

* * * * *